United States Patent [19]

Burnett

[11] 4,418,334

[45] Nov. 29, 1983

[54] SIGNAL DISPLAY SYSTEM AND LUMINAIRE APPARATUS FOR OPERATING SAME

[76] Inventor: Dorothy K. Burnett, 87 Pine St., Belmont, Mass. 02178

[21] Appl. No.: 228,270

[22] Filed: Jan. 26, 1981

[51] Int. Cl.[3] ..... G08B 7/06

[52] U.S. Cl. ..... 340/332; 340/286 R; 340/573; 340/815.02; 340/825.49

[58] Field of Search ..... 340/332, 573, 574, 371, 340/378.1, 331, 326, 293, 286, 825.47, 825.36, 815.21, 815.02

[56] References Cited

U.S. PATENT DOCUMENTS

| | | | |
|---|---|---|---|
| 1,367,583 | 2/1921 | Bobroff | 340/332 |
| 2,736,888 | 2/1956 | McLain | 340/825.49 |
| 2,910,680 | 10/1959 | McLain | 340/332 |
| 2,971,135 | 2/1961 | Ebert | 340/332 |
| 3,430,224 | 2/1969 | Krantz | 340/825.36 |
| 3,585,629 | 6/1971 | Baynard, Jr. | 340/332 |
| 3,651,512 | 3/1972 | Summers | 340/286 |

*Primary Examiner*—Glen R. Swann, III
*Attorney, Agent, or Firm*—Hamilton, Brook, Smith & Reynolds

[57] ABSTRACT

A nurse's call system is constructed for use in hospitals, nursing homes and the like wherein classified groups of services are provided including (a) services lowest in importance rendered by a nurse's aide; (b) services of greater importance rendered by a nurse or a doctor; and (c) services of greatest importance rendered by an emergency unit or team including units to deal with cardiac arrest, hemorrhage, shock, suffocation, oxygen requirements, and the like. The call system comprises a luminaire apparatus including a call lamp located at the nurse's call station, electrical circuitry connecting the call lamp with a remotely located patient's room, and a portable call box located at the patient's room at a patient's bedside. The call box is provided with a plurality of switches for energizing the call lamp and producing light signals of differing light characteristics which are arranged or coded in an ascending order of importance and which are correlated with the classified groups of hospital services noted. As each light signal is received at the nurse's call station, the characteristics of the coded light emission indicates the order of magnitude of urgency desired in obtaining a signal response, as well as the specific assistance a patient may require.

7 Claims, 10 Drawing Figures

SIGNAL DISPLAY SYSTEM AND LUMINAIRE APPARATUS FOR OPERATING SAME

FIELD OF THE INVENTION

Various proposals have been made in the art for communication between a bed patient and a nurse's call station. However, it is understood that only one simple signal display system is now in use in most hospitals and is presently being installed in newly constructed hospitals. Essentially, this simplified call system includes a display light located in a nurse's call station and, electrical circuit means connecting the display light with a portable hand held call box in a remotely located patient's room.

U.S. Pat. No. 1,367,583 discloses a system in which signals are displayed outside a patient's room in response to operation by the patient of a motor driven enunciated drum which selects the services required by the patient, all of which are now provided in a patient's room and only a nurse's call is achieved by this patent.

U.S. Pat. No. 2,736,888 also discloses an enunciator system by means of which a patient may indicate specific services utilizing a transformer and relay box which is required to be supported on a stand or table beside a patient's bed in a position which necessarily interferes with the normal servicing attention given by a nurse to a patient. There is limited the number of patient requests which can be made.

U.S. Pat. No. 2,910,680 discloses another form of enunciator means by which a patient may indicate services required through a bank of switch buttons which are required to be supported beside a patient's bed in a way to obstruct normal nursing services. There is limited the number of patient requests which can be made. The equipment limits information to conversation between patient and nurses station, delays arrival of urgent calls when multiple calls are being made in rotation, is cumbersome for aids and nurses already on the floor, omits bathroom, uses nurse's time for multiple calls, no proper emergency call from patient's bed, and makes no provision for non-emergency calls from bathroom.

SUMMARY OF THE INVENTION

This invention relates to a call system for use in hospitals, nursing homes and the like wherein services provided may be classified in groups of varying importance in responding to a patient's needs including services lowest in importance rendered by a nurse's aide, services of relatively greater importance rendered by a nurse or a doctor, and services of greatest importance rendered by an emergency unit or team.

It is a chief object of the invention to provide a call system by means of which a bed patient may transmit to a nurse's call station a call which is specific in terms of importance and selected from any one of the groups noted above.

Another object is to provide a call system including a call lamp and means for energizing the call lamp to provide display signals having differing light characteristics referenced to the importance of the patient's need.

Another object is to construct a portable hand held call box which may be conveniently attached to a patient's bedside and which contains a plurality of switches arranged in such relationship to one another that each switch may be recognized by touch.

Another object of the invention is to provide a call box structure in which a plurality of switches are located and in which any one or all of the switches may be rendered inoperative by nursing personnel.

Another object is that each more urgent signal automatically overrides a less urgent signal.

Another object is to provide cancel buttons operable by the patient.

The nature of the invention and its other objects are novel features. It will be more fully understood and appreciated from an inspection of the drawings and the detailed description thereof as hereinafter set forth.

BRIEF DESCRIPTION OF THE DRAWINGS

FIG. 1 is a diagrammatic view illustrating fragmentarily a call station which may represent a nurse's call station in a hospital, nursing home or the like.

DETAILED DESCRIPTION OF THE INVENTION

The call system of the invention in its broadest aspect comprises a luminaire apparatus which, although not limited thereto, is hereinafter described with reference to providing a bed patient in a hospital, nursing home or the like with the means of communicating specific information to a nurse's call station and/or over the door of the patient's room simultaneously. In general, it is intended that the invention system may be used in place of existing systems now in use in most hospitals. In this conventional system an electrical circuit means connects a lamp in the nurse's call station with a patient's control unit in a remotely located patient's room and the control unit is located near the patient's bed. It is contemplated that the signal display system of the invention may, although not necessarily, be arranged to use the electrical circuit noted in common with the conventional system and that nursing personnel may, in some cases, wish to use the invention system as an alternate to the conventional system to meet with any given set of conditions.

A detailed description of the invention is therefore hereinafter set forth based on the assumption that the call system may be utilized as either a replacement of existing systems or as an alternate system which may be employed at will under the control at all times of nursing personnel.

Figure 2:
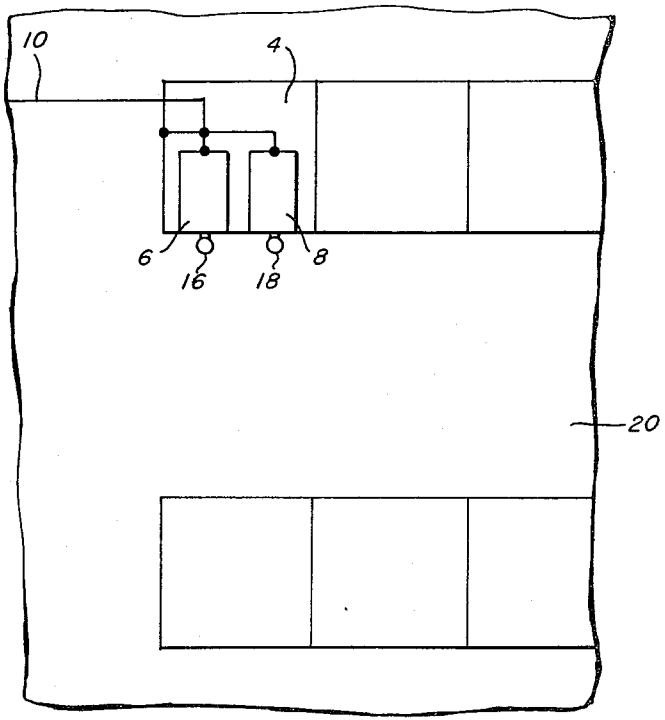
FIG. 2 is another diagrammatic view illustrating fragmentarily hospital floor area and a patient's room communicating therewith.
Figure 1:
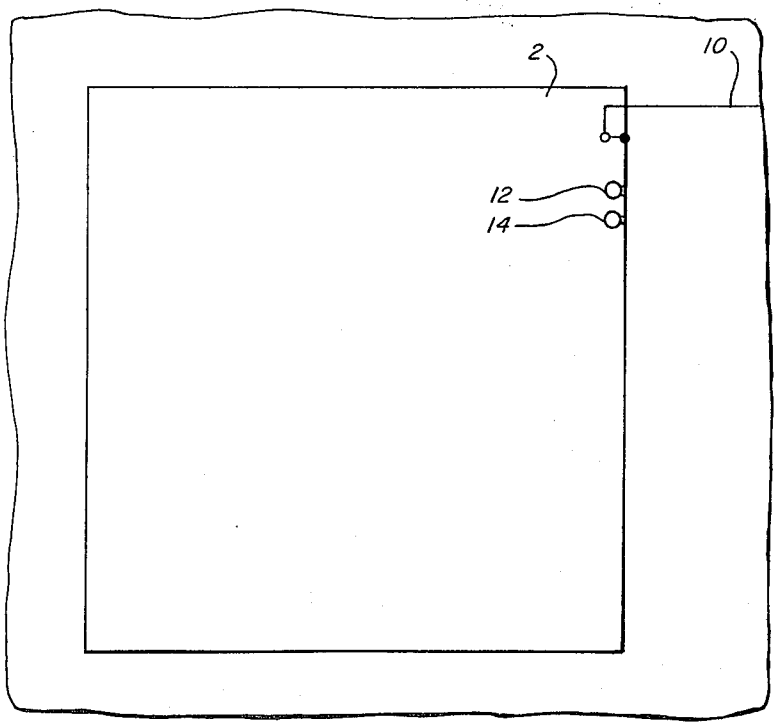

Referring in more detail to the drawings, attention is directed to FIGS. 1 and 2 wherein numeral 2 denotes a nurse's call station and numeral 4 denotes a patient's room in which are located two patient's beds 6 and 8. Electrical circuit means 10 is connected between the call station 2 and room 4 and provides for a lamp 12 mounted at the call station being selectively operated through a switch located near bed 6 and also provides for a lamp 14 being operated by a switch by a patient in bed 8. In a preferred embodiment of the call system of the invention there may also be provided a lamp 16 which is located outside of the patient's room 4 in a position to be visually observed by personnel or other parties passing along the corridor 20 and which only energized by a patient in bed 6. Similarly, a lamp 18 is located outside of room 4 and may be operated only by a bed patient in bed 8.

It is intended that both of the lamps in each set, for example lamp 12 and lamp 16, may be operated concurrently from bed 6 and that lamps 14 and 18 may be operated concurrently from bed 8. It will be understood, however, that the luminaire apparatus of the invention is not limited to the utilization of pairs of lamps and control of lamps 12 and 16, as noted below, may be carried out without the use of lamps 14 and 18.

In accordance with the invention there is provided individual call boxes for each of the patients in beds 6 and 8 and it will be understood that for rooms having a larger number of beds additional units may be furnished.

Each call box, unlike the single thumb switch in conventional call systems noted above, includes a plurality of switches any one of which may be operated by a patient at will as hereinafter described.

Figure 3:
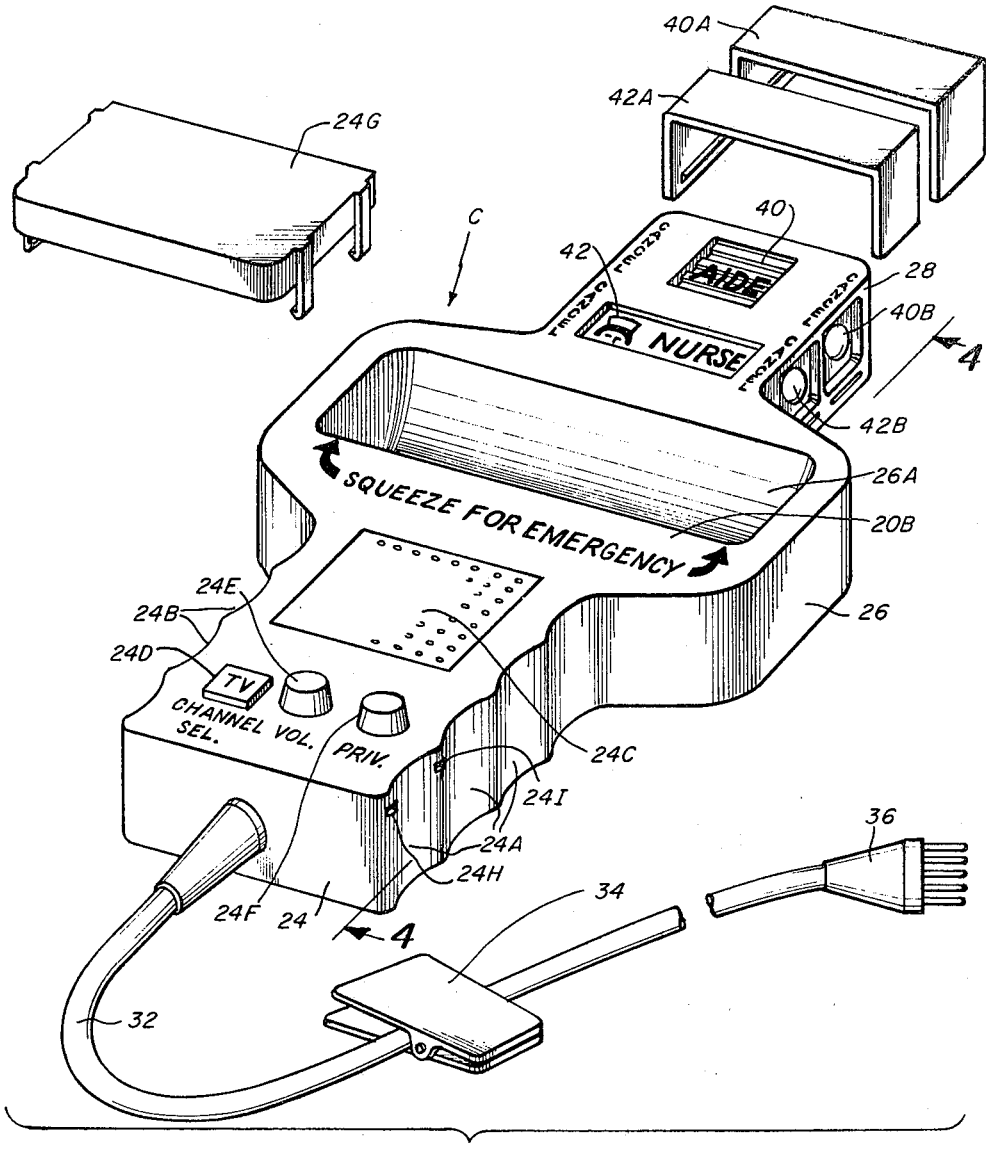
FIG. 3 is a perspective view illustrating a call box for use by a bed patient in operating the call system of the invention.
Figure 7:
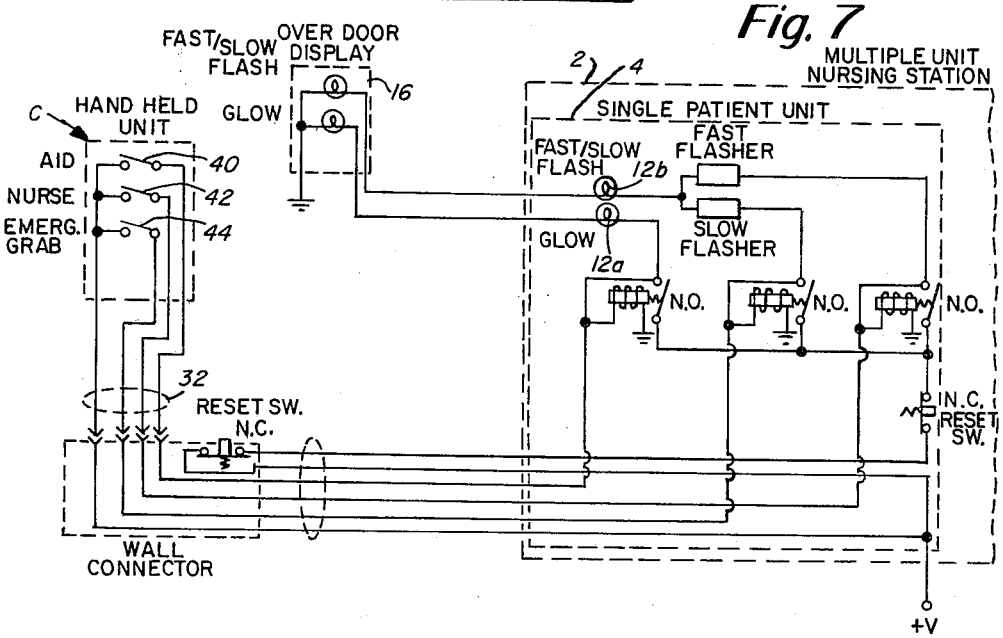
FIG. 7 is a schematic view illustrating diagrammatically the call system of the invention including electrical circuit means and switches.

In FIG. 3 there is illustrated a call box which is generally indicated by the arrow C. Call box C is also shown diagrammatically in FIG. 7 wherein there is illustrated electrical circuit means operable by the multiple switches of call box C to engage lamp 12 and display signals of differing light characteristics. Also illustrated diagrammatically in FIG. 7 is the nurse's call station 2 and lamp means 16 located ouside the patient's room 4. Lamp 12 may include a sustained glow filament 12*a* and a fast/slow flash filament 12*b*, as indicated in FIG. 7. The construction and operation of the call box C by means of the electrical circuitry of FIG. 7 will be described below with reference to manual control of the call box C by a patient in bed 6.

As shown in FIG. 3, the call box C comprises a relatively flat holder body designed to be hand held by a bed patient or other operator having a plurality of spaced apart switches supported at the upper side of the holder body for convenient engagement by outstretched fingers of a patient.

The holder body is formed, by plastic molding or other suitable methods, with a rear portion 24, an intermediate, enlarged portion 26 and a relatively narrow front portion 28. At their undersides the portions 24, 26 and 28 have a common flat surface 30 which may be provided with a non-skid backing for enabling the holder body to resist sliding movement when placed on a bed or other surface.

Connected to the rear portion 24 is an electrical cable 32 of the coaxial type and through which is attached a clip 34 which may be used to secure the holder to a bed cover. At its other end the conductor 32 is provided with a plug 36 for engagement in a wall receptacle.

As noted above, there are provided at the upper side of the call box C three electrical switches 40, 42 and 44 which, in accordance with the invention, are provided to correspond to the three groups of hospital services earlier noted and classified in terms of importance in responding to a patient's need. (See FIGS. 3 and 4.) These switches may be manually operated by a patient in bed 6 to selectively energize the call lamp 12 at the nurse's station and provide display signals with differing light characteristics which are arranged or coded in an ascending order of importance correlated with the three groups of hospital services.

An important feature of the invention is the arrangement of the switches in an ascending order of importance such that as any one of the switches is closed and a signal is transmitted to the nurses station, the lamp 12 displays by its light emitting characteristics an order of magnitude of the urgency required in obtaining a signal response.

Considering in more detail the switches 40, 42 and 44, the switch 40 is termed a nurse's aide switch and when closed causes the lamp 12 to emit a sustained emission of light of low intensity. This switch is located in a forwardly extending position such that it may be readily engaged by a patient's finger and the exterior surface of the switch is of a roughened texture easily recognized by the sense of touch of a patient. This switch is lowest in order of importance of the three switches noted and may be used to call a hospital aide or other attendant when not requiring the full services of a nurse or emergency unit.

Switch 42 is a nurse's call switch and is located rearwardly of and quite close to switch 40, as viewed in FIG. 3 and is characterized by a relatively smooth surface as compared with the roughened, textured surface of switch 40. Therefore, this smooth surface is readily selected by finger touch when the services of a nurse are required.

Switch 42 is of a higher order of importance than switch 40 and, as shown in FIG. 7, it is electrically connected to provide for disabling switch 40 when operated. The electrical circuitry of FIG. 7 includes relay controls which provide for an emission of light periodically at a relatively slow rate to provide a different signal when compared with a sustained emission signal of switch 40.

It will be seen that the nurse's call system provides a patient with a wide range of services which are normally provided from a nurse's station and which are quite distinct from services provided by a nurse's aide.

The third and most important switch is switch 44 which controls a call for an emergency signal at the nurse's station. When this switch is closed it operates through the electrical circuit of FIG. 7 by the use of a relay means to provide a periodic emission of light from lamp 12 at a rate significantly faster than the rate of emission of light signals when switch 42 is operating. As may be more clearly seen in FIG. 4 this switch 44 is protectively contained in a manner such that it can be reached and operated by a simple hand gripping movement. The intermediate portion 26 of the call box C is of an increased width chosen with reference to the size of a patient's hand and is recessed to provide a hand slot 26A which extends rearwardly to constitute a gripping bar 26B at the underside of which is supported switch bar 44.

By means of the arrangement disclosed a simple gripping movement is adequate to operate the switch and the patient can readily reach out and insert his fingers in the slot 26A and then grip these fingers around the switch bar 44. It will be noted that with this protectively housed arrangement accidental closing of switch 44 is prevented in most situations.

Closing switch 44 as described operates not only to activate lamp 12 but also disables switches 40 and 42 by means of the electrical circuitry of FIG. 7 and is so arranged that it may take precedence when either switch 40 or 42 is closed. Thus, it will be apparent that an emergency call heretofore limited to a bathroom location may be transmitted by a patient from his bed which is a control of a highly important nature.

Portion 24 of the control unit C is formed of a size suitable for being gripped in a patient's hand when the unit is to be moved about and at opposite edges of the portion 24 are provided finger slots as 24A and 24B.

It is pointed out that a unique arrangement of parts well suited to the needs of a bed patient is realized by the provision of the hand grip of portion 24 with its finger slots 24A and 24B closely adjacent to the emergency switch 44. By means of this arrangement of parts the patient may guide his hand forwardly from the part 24 across the hand slot 26A and make finger contact with either switch 40 or 42 and this may be done without lighting by the use of touch alone. The switch may be readily operable by patients with minimal physical functioning, i.e. one hand, partial paralysis unable to speak, see or hear, immobilized in a prone position.

There may also be provided in the rear portion 24 of unit C outlets of a conventional nature such as a combination microphone and speaker unit 24C, connected to a power source through a cable 32.

In the use of the call box C as above described there may arise instances where nursing personnel may prefer to have a patient use a single light switch such as the emergency switch 44 without becoming confused because of a three switch arrangement or for other reasons. With this in mind there has been further provided cover clips for covering over the nurse's aid switch 40 and the nurse's call switch 42, as well as the controls provided in the rear portion 24 of the unit C.

As shown in FIG. 3, a cover clip 40A of U-shaped configuration may be provided to overlie aide switch 40 so that it cannot be operated. The switch 40 may also have a disconnect button 40B and the U-shaped clip may be employed to prevent operation of the button 40B when not desired as well as switch 40.

Similarly, a cover clip 42A may be provided to overlie switch 42 so that it cannot be operated and one side of clip 42A is arranged to prevent operation of the disconnect button 42B.

A third clip 24G may also be detachably engaged with projections as 24H and 24I on rear portion 24 of call box C to prevent use of the control in the rear portion 24.

Figure 9:
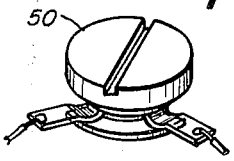
FIG. 9 is a detail view of another alternative form of switch means.

It may also be desired to utilize other means for rendering any one or all of the switches 40, 42, and 44 inoperative. For example, it may be desired to locate in bottom side 30 of the call box C enabling switches for any one or all of the switches 40, 42 and 44 and in FIG. 9 there is illustrated a simple form of enabling switch which may be substituted for the switch 40 and which is operated by means of a key or a coin.

Figure 4:
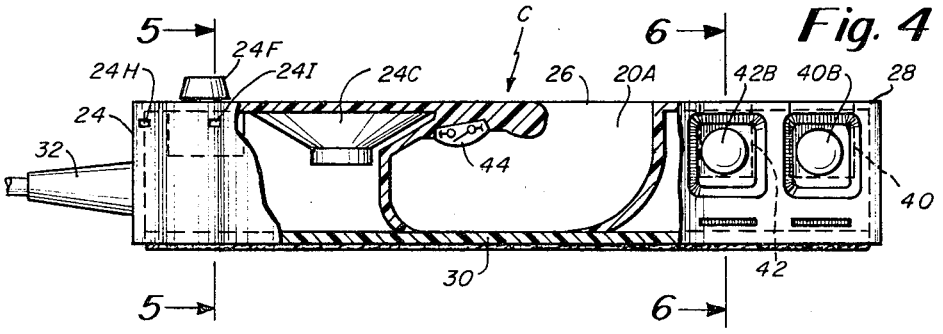
FIG. 4 is a cross-section taken on the line 4—4 of FIG. 3.
Figure 5:
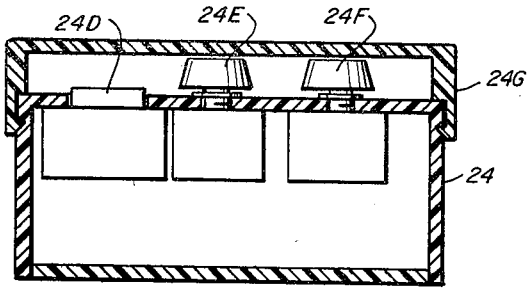
FIG. 5 is a cross-section taken on the line 5—5 of FIG. 4.
Figure 6:
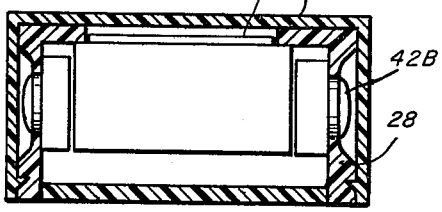
FIG. 6 is a cross-section taken on the line 6—6 of FIG. 4.
Figure 8:
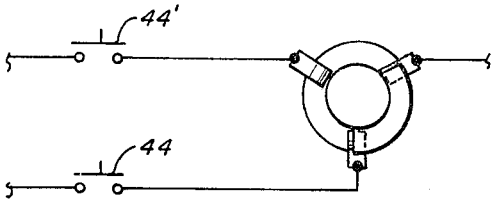
FIG. 8 is a detail view of an alternate form of switch means for use with the call box of FIG. 3.

In FIG. 8 there is illustrated a dual switch arrangement by means of which switch 44 may operate as shown in FIG. 4, or may operate through a switch 44' which may be located at the top of the portion 26 and which may be regarded "fall on" switch which might be used by one who has no other recourse.

Figure 10:
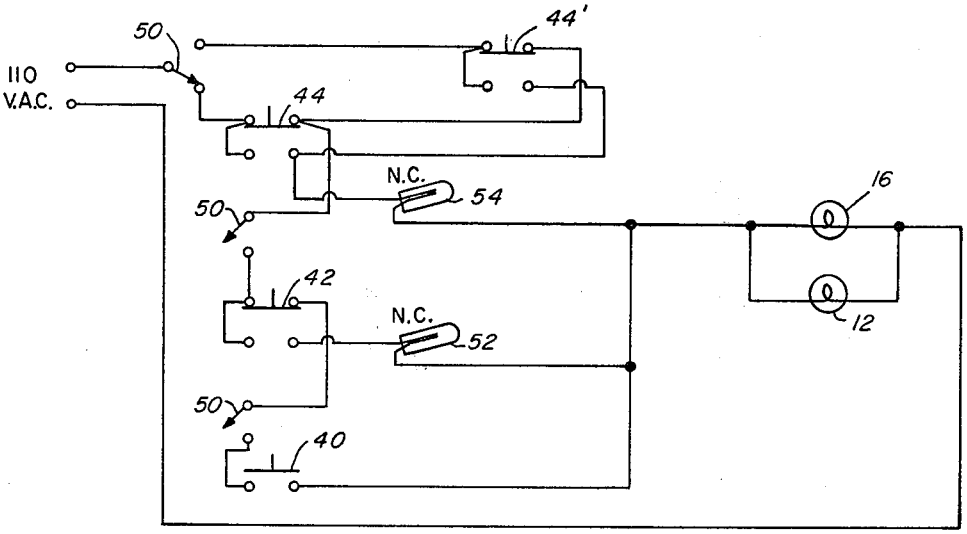
FIG. 10 is a diagrammatic view illustrating still another modification of switch and circuitry for the call box 4 of FIG. 3.

In FIG. 10 there is illustrated an enabling switch 50 at the bottom 30 for selectively operating any of the switches utilizing bimetallic members 52 and 54 for controlling fast and slow periodic operation of the light 12.

What is claimed is:

1. A call system for use in hospitals, nursing homes and the like, wherein services provided may be classified in three groups in terms of importance in responding to the patient's needs including services lowest in importance by a nurse's aide, services of greater importance rendered by a nurse or a doctor and services of greatest importance rendered by an emergency unit or team, said call system comprising a luminaire apparatus including a call lamp to be located at a nurse's call station, electrical circuitry for connecting the call lamp with a patient's room at a distance from the call station and a portable call box located in the patient's room at a patient's bedside, said call box having constructed therein a plurality of switches for selectively energizing the call lamp and producing light signals or differing light characteristics which are arranged or coded in ascending order of importance and which are correlated with the said three classified groups of services.

2. The invention of claim 1 in which each of the signals arriving at the nurse's call station indicates an order of magnitude of urgency required in obtaining a signal response.

3. The invention of claim 1 in which the call signal lowest in importance for a nurse's aide is of constant low intensity characteristics, the signal for the nurse's call is of a relatively slow flashing characteristic, and the signal for the emergency call is of a rapid flashing characteristic.

4. The invention of claim 1 characterized in that the nurse's call, when energized, disconnects the circuit for the nurse's aide call, and the emergency call and the nurse's aide call, when energized, disconnects the circuit for the nurse's call.

5. The invention of claim 1 in which the nurse's aide switch presents a roughened exterior while the nurse's call switch presents a smooth contact surface, and the emergency call switch is recessed in the call box in a position to be operated by gripping pressure of a patient's finger curled therearound.

6. The invention of claim 1 in which the call box comprises an elongated, relatively flat holder body having a holder end formed with finger slots to be handheld by a patient, the opposite end of the holder body having a nurse's aide switch mounted therein and a nurse's call switch arranged in closely spaced relation to the nurse's aide switch, an intermediate portion of the call box having an emergency switch supported therein, said intermediate portion being formed of increased width and recessed to define a gripping slot in which a patient's hand may be inserted, said gripping slot having a relieved edge portion and a switch bar mounted at the underside of the relieved edge in protectively contained relationship to prevent accidental operation, and said switch bar being operable by gripping pressure of a patient's fingers moved thereagainst.

7. The invention of claim 1 in which the call box comprises an elongated, relatively flat holder body having a holder end formed with finger slots to be handheld by a patient, the opposite end of the holder body having a nurse's aide switch mounted therein and a nurse's call switch arranged in closely spaced relation to the nurse's aide switch, an intermediate portion of the call box having an emergency switch supported therein, said intermediate portion being formed of increased width and recessed to define a gripping slot in which a patient's hand may be inserted, said gripping slot having a relieved edge portion and a switch bar mounted at the underside of the relieved edge in protectively contained relationship to prevent accidental operation, and said switch bar being operable by gripping pressure of a patient's fingers moved thereagainst, and said call box including cover clip means which may be secured over the nurse's aide switch and the nurse's call switch to provide for only the emergency switch being operable at any desired time.

* * * * *